US011568726B2

(12) United States Patent
Bergman et al.

(10) Patent No.: US 11,568,726 B2
(45) **Date of Patent: *Jan. 31, 2023**

(54) SYSTEMS AND METHODS FOR DEACTIVATION FREQUENCY REDUCTION USING A TRANSFORMER

(71) Applicant: Sensormatic Electronics, LLC, Boca Raton, FL (US)

(72) Inventors: Adam S. Bergman, Boca Raton, FL (US); Ronald B. Easter, Parkland, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/200,482

(22) Filed: Mar. 12, 2021

(65) Prior Publication Data

US 2021/0201641 A1 Jul. 1, 2021

Related U.S. Application Data

(63) Continuation of application No. 16/080,054, filed as application No. PCT/US2018/025925 on Apr. 3, 2018, now Pat. No. 10,964,183.

(51) Int. Cl.
*G08B 13/24* (2006.01)

(52) U.S. Cl.
CPC ..... *G08B 13/242* (2013.01)

(58) Field of Classification Search
CPC ..... G08B 13/2411; G08B 13/242
See application file for complete search history.

(56) References Cited

U.S. PATENT DOCUMENTS 6,037,716 A 3/2000 Shikama et al.
2005/0275507 A1* 12/2005 Hall ..... G08B 13/2411 340/300
2008/0088460 A1* 4/2008 Copeland ..... H01Q 1/2216 340/572.7
2009/0121871 A1* 5/2009 Leone ..... G08B 13/2411 340/572.1

(Continued)

FOREIGN PATENT DOCUMENTS

WO 1995013470 A1 5/1995

OTHER PUBLICATIONS

International Search Report and Written Opinion dated Jul. 11, 2018 for PCT/US18/25925.

*Primary Examiner* — Kam Wan Ma
(74) *Attorney, Agent, or Firm* — ArentFox Schiff LLP

(57) ABSTRACT

Systems and methods for deactivating an Electronic Article Surveillance ("EAS") tag. The methods comprising: using an AC drive signal to charge an energy storage component of the tag deactivator; selectively actuating a switch so that a closed circuit is formed between the energy storage component and at least one deactivation coil of the tag deactivator; generating a tag deactivation field to deactivate the EAS tag by energizing the at least one deactivation coil with current supplied from the energy storage component; and using a step down transformer, disposed between the energy storage component and the at least one deactivation coil, to decrease a frequency of a decaying coil current waveform representing a current flowing through the at least one deactivation coil.

20 Claims, 8 Drawing Sheets

(56) References Cited

U.S. PATENT DOCUMENTS

2009/0295584 A1* 12/2009 Leone ..... G08B 13/2411
340/572.3
2013/0278426 A1* 10/2013 Sayegh ..... G08B 13/2488
340/572.3

* cited by examiner

Graph 500

Graph 700

SYSTEMS AND METHODS FOR DEACTIVATION FREQUENCY REDUCTION USING A TRANSFORMER

CROSS-REFERENCE TO RELATED APPLICATIONS

This application claims priority to U.S. application Ser. No. 16/080,054, entitled "SYSTEMS AND METHODS FOR DEACTIVATION FREQUENCY REDUCTION USING A TRANSFORMER," filed Aug. 27, 2018, which is a 35 U.S.C. § 371 National Phase of PCT Application No. PCT/US2018/025925, filed on Apr. 3, 2018, each of which is hereby incorporated by reference in their entireties.

BACKGROUND

Statement of the Technical Field

The present disclosure relates generally to Electronic Article Surveillance ("EAS") systems. More particularly, the present disclosure relates to implementing systems and methods for deactivation frequency reduction using a transformer.

Description of the Related Art

A typical EAS system in a retail setting may comprise a monitoring system and at least one security tag or marker attached to an article to be protected from unauthorized removal. The monitoring system establishes a surveillance zone in which the presence of security tags and/or markers can be detected. The surveillance zone is usually established at an access point for the controlled area (e.g., adjacent to a retail store entrance and/or exit). If an article enters the surveillance zone with an active security tag and/or marker, then an alarm may be triggered to indicate possible unauthorized removal thereof from the controlled area. In contrast, if an article is authorized for removal from the controlled area, then the security tag and/or marker thereof can be deactivated and/or detached therefrom. Consequently, the article can be carried through the surveillance zone without being detected by the monitoring system and/or without triggering the alarm.

The security tag, label or marker is deactivated in certain scenarios, such as when the article to which it is affixed has been successfully purchased. A deactivation unit is used to deactivate the security tag, label or marker. The deactivation unit employs complex electronics configured to generate a deactivation waveform.

In some regions, regulatory bodies have established increasingly stringent human exposure limits for certain electrical device (including the security tag or marker deactivation unit). Some EAS deactivation equipment does not meet the updated human exposure limits.

SUMMARY

The present disclosure generally concerns implementing systems and methods for deactivating an EAS tag, label or marker. The methods comprise: using an AC drive signal to charge an energy storage component (e.g., a storage capacitor) of the tag deactivator; selectively actuating a switch so that a closed circuit is formed between the energy storage component and at least one deactivation coil of the tag deactivator; generating a tag deactivation field to deactivate the EAS tag, label or marker by energizing the at least one deactivation coil with current supplied from the energy storage component; and using a step down transformer, disposed between the energy storage component and the at least one deactivation coil, to decrease a frequency of a decaying coil current waveform representing a current flowing through the at least one deactivation coil.

In some scenarios, the AC drive signal is provided by a controller external to the tag deactivator. The controller can include, but is not limited to, a Point Of Sale ("POS") terminal. The switch is selectively actuated in response to a tag deactivation command provided by the POS terminal when an item to which the EAS tag is coupled has been successfully purchased.

In those or other scenarios, the step down transformer has a turn ratio between 3 and 4. The frequency is decreased by approximately the turns ratio of the transformer (e.g., to a value less than 1.8 kHz, and/or by at least half). The at least one deactivation coil comprises a first coil located in the first plane that is horizontal to ground and a second coil located in the second plane that is vertical to ground.

BRIEF DESCRIPTION OF THE DRAWINGS

The present solution will be described with reference to the following drawing figures, in which like numerals represent like items throughout the figures.

DETAILED DESCRIPTION

Figure 1:
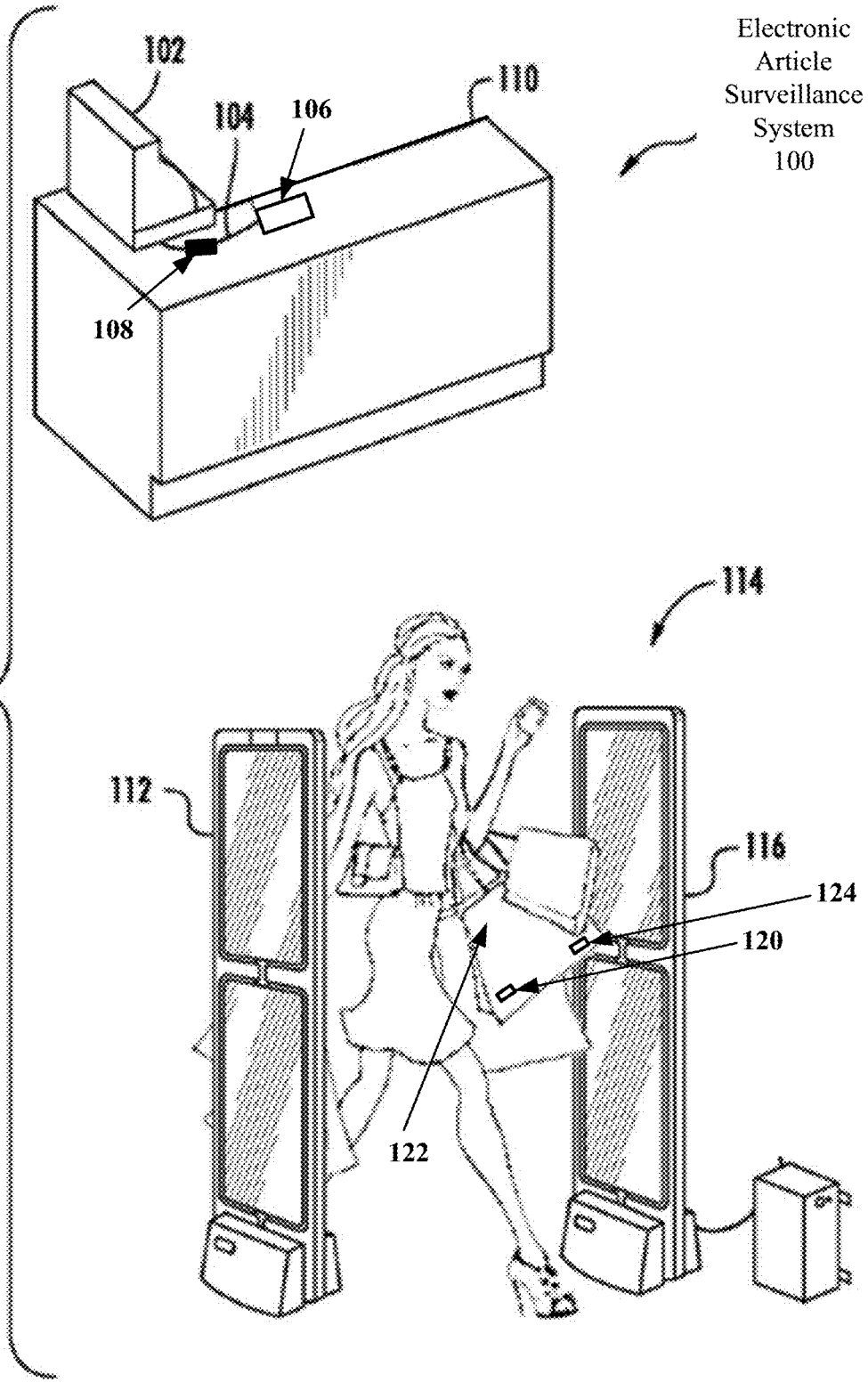
FIG. 1 is an illustration of an illustrative EAS system.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present solution may be embodied in other specific forms without departing from its spirit or essential characteristics. The described embodiments are to be considered in all respects only as illustrative and not restrictive. The scope of the present solution is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present solution should be or are in any single embodiment of the present solution. Rather, language referring to the features and advantages is understood to mean that a specific feature, advantage, or characteristic described in connection with an embodiment is included in at least one embodiment of the present solution. Thus, discussions of the features and advantages, and similar language, throughout the specification may, but do not necessarily, refer to the same embodiment.

Furthermore, the described features, advantages and characteristics of the present solution may be combined in any suitable manner in one or more embodiments. One skilled in the relevant art will recognize, in light of the description herein, that the present solution can be practiced without one or more of the specific features or advantages of a particular embodiment. In other instances, additional features and advantages may be recognized in certain embodiments that may not be present in all embodiments of the present solution.

Reference throughout this specification to "one embodiment", "an embodiment", or similar language means that a particular feature, structure, or characteristic described in connection with the indicated embodiment is included in at least one embodiment of the present solution. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

As noted above, regulatory bodies have established increasingly stringent human exposure limits for certain electrical device (including the security tag or marker deactivation unit). The regulations limit induced fields. Some EAS deactivation equipment needs to be updated to ensure that the updated human exposure limits are being met. Since lowering the amplitude of the drive signal (voltage of the storage device) is not desired, lowering the frequency is an option which requires increasing the inductance of the coil. The limiting factor is the allowed volume in mechanical housings, such as an integrated scanner implementation.

By locating a transformer between an existing controller and a deactivation antenna, the present solution is able to pass proposed new regulations which require a reduction in human exposure fields (induced fields) without impacting EAS deactivation performance. The inclusion of the transformer results in a lower frequency waveform and lower induced exposure fields. The function of the transformer is actually to increase the impedance of the tag deactivator to alternating current. This is necessary since there is typically not adequate space in any antenna housing to use a large antenna (more inductance).

The current trend is to locate EAS deactivation antennas within a laser or barcode scanner at a POS. As such, the present solution will be described below in relation to POS applications. The present solution is not limited in this regard since it can be implemented various other non-POS applications.

Illustrative EAS System

Referring now to FIG. 1, there is provided an illustration of an EAS system 100 that is useful for understanding the present solution. EAS systems are well known in the art, and therefore will not be described in detail herein. Still, it should be understood that the present solution will be described herein in relation to an AM (or magnetostrictive) EAS system. The EAS system 100 generally prevents the unauthorized removal of articles from a retail store.

In this regard, EAS security tags 120 are securely coupled to articles (e.g., purses, clothing, toys, and other merchandise) offered for sale by the retail store. At the exits of the retail store, detection equipment 114 sounds an alarm or otherwise alerts store employees when it senses an active EAS security tag 120 in proximity thereto. Such an alarm or alert provide notification to store employees of an attempt to remove an article from the retail store without proper authorization.

In some scenarios, the detection equipment 114 comprises antenna pedestals 112, 116. The antenna pedestals 112, 116 are configured to create a surveillance zone at the exit or checkout lane of the retail store by transmitting an EAS exciter signal. The EAS exciter signal causes an active EAS security tag 120 to produce a detectable response if an attempt is made to remove the article from the retail store.

For example, the EAS security tag 120 can cause perturbations in the EAS exciter signal. Each antenna pedestal 112, 116 is used to generate an Electro-Magnetic ("EM") field which serves as a security tag exciter signal. The security tag exciter signal causes a mechanical oscillation of a strip (e.g., a strip formed of a magnetostrictive or ferromagnetic amorphous metal) contained in an EAS security tag within the surveillance zone. As a result of the stimulus signal, the EAS security tag 120 will resonate and mechanically vibrate due to the effects of magnetostriction. This vibration will continue for a brief time after the stimulus signal is terminated. The vibration of the strip causes variations in its magnetic field, which can induce an AC signal in the receiver antenna. This induced signal is used to indicate a presence of the strip within the surveillance zone. The same antenna contained in a pedestal 112, 116 can serve as both the transmit antenna and the receive antenna. Accordingly, the antennas in each of the pedestals 112, 116 can be used in several different modes to detect a security tag exciter signal.

The EAS security tag 120 can be deactivated using a Multi Technology System ("MTS") 106. The MTS 106 is shown in FIG. 1 as being located at a checkout counter 110 of a retail store and communicatively coupled to a POS terminal 102 via a wired link 104. In general, the POS terminal 102 facilitates the purchase of articles from the retail store. POS terminals are well known in the art, and therefore will not be described herein. Any known or to be known POS terminal can be used herein without limitation.

The MTS 106 comprises a barcode scanner and a tag deactivator. These components of the MTS 106 will be discussed in detail below in relation to FIGS. 2-3 and 6-7. The EAS security tag 120 is deactivated by store employees during a purchase transaction. For example, the EAS security tag 120 is deactivated while the item 122 is passed over the MTS 106 for barcode scanning purposes. The barcode scanning facilitates the purchase transaction for the item 122. The present solution is not limited to the particulars of this example. For example, the EAS security tag 120 is alternatively deactivated when the corresponding item 122 has been successfully purchased or has been otherwise authorized for removal from the retail store.

In some cases, the MTS 106 is configured to operate as an RFID reader. As such, the MTS 106 may transmit an RFID interrogation signal for purposes of obtaining RFID data from a dual technology security tag (i.e., an EAS and RFID security tag). Upon receipt of the unique identifier, the MTS 106 communicates the unique identifier to the POS terminal 102. At the POS terminal 102, a determination is made as to whether the unique identifier is a valid unique identifier for an EAS security tag of the retail store. If it is determined that the unique identifier is a valid unique identifier for an EAS security tag of the retail store, then the POS terminal 102 notifies the MTS 106 that the unique identifier has been validated, and therefore the EAS security tag 120 can be deactivated.

As noted above, a tag deactivator is embedded in the MTS 106. The tag deactivator performs operations to generate low frequency magnetic fields to demagnetize the AM based security tags, markers or labels in response to the notification received from the POS terminal 102. In the present document, the terms tag, marker and label are used interchangeably. The demagnetization fields use a large amount of instantaneous energy and create magnetic fields that may exceed certain human exposure limits set by regulatory bodies. The present solution reduces the induced field strength to levels lower than that used today. The reduction in the generated magnetic field strength is achieved by providing a transformer 108 between the POS terminal 102 and the deactivation coil(s) of the MTS 106. Transformer 108 includes, but is not limited to, a step down transformer. Step down transformers are well known in the art, and therefore will not be described herein. Any known or to be known step down transformer can be used herein in accordance with a given application. In some scenarios, the step down transformer 108 has turn ratio N between 3 and 4 (e.g., N=3.54). The present solution is not limited in this regard.

The step down transformer increases an impedance Z of a tag deactivator coil circuit to alternating current. In effect, the inductance of the deactivation coil(s) appears larger without changing the physical sizes thereof. The result is a decaying coil current waveform with a lower frequency, whereby a lower induced field is produced. The induced field is proportional to the waveform frequency. The present solution does not have any impact on the tag deactivator's performance, and also does not require any modifications to at least the deactivation coil(s) of the MTS 106.

Figure 2:
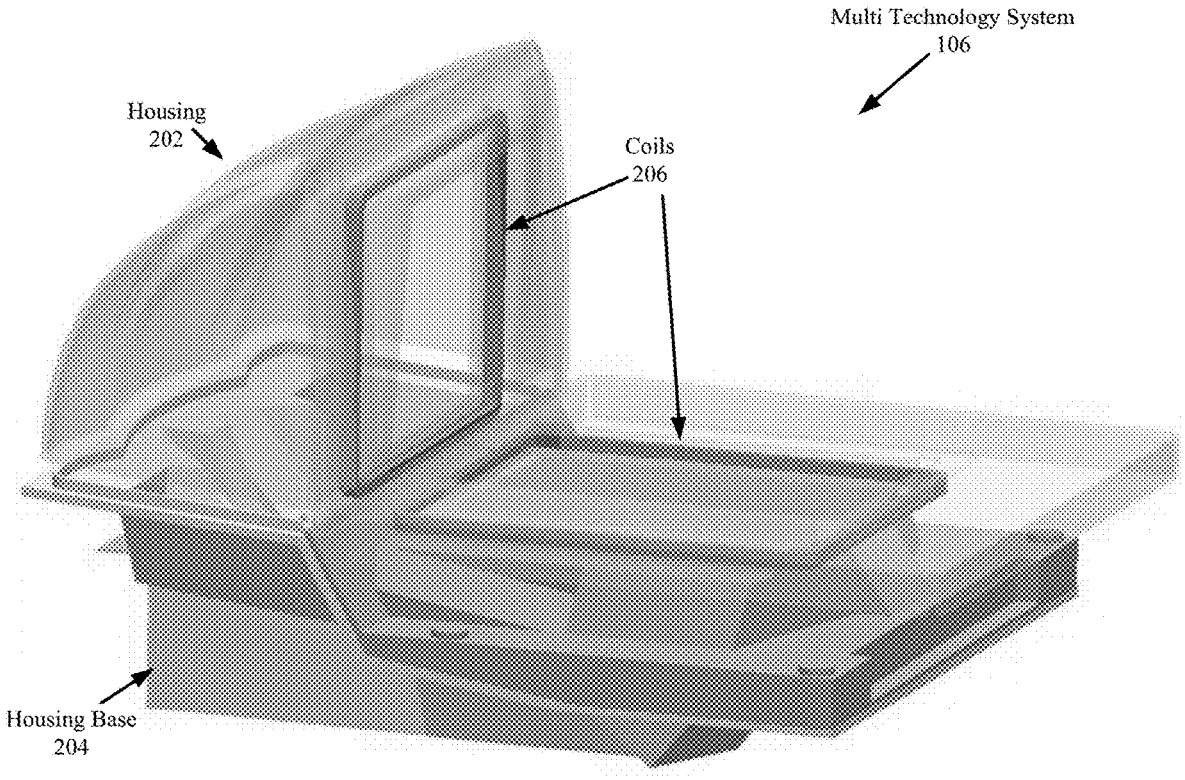
FIG. 2 is an illustration of the multi technology system shown in FIG. 1.

Referring now to FIG. 2, there is provided an illustration of an illustrative architecture for the MTS 106. The MTS 106 comprises a housing 202 in which two deactivation coils 206 are disposed. The coils 206 are arranged so as to be perpendicular to each other, i.e., a first coil is located in the first plane that is horizontal to ground and a second coil is located in the second plane that is vertical to ground. The present solution is not limited in this regard. The present solution can additionally be used in applications where less than or more than two deactivation coils are employed. Various electronics are disposed in a housing base 204. A block diagram of these electronics is provided in FIG. 3.

Figure 3:
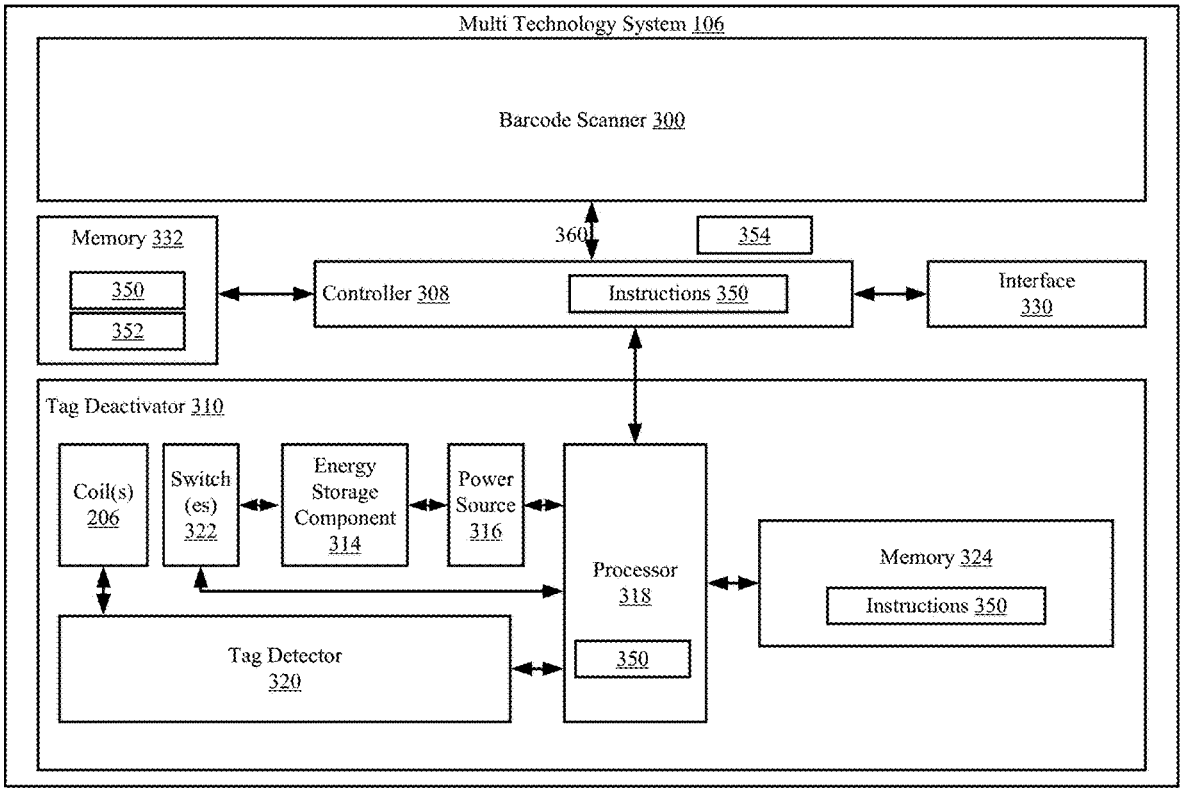
FIG. 3 is a block diagram for the multi technology system shown in FIGS. 1-2.

As shown in FIG. 3, the electronics include a barcode scanner 300. Barcode scanners are well known in the art, and therefore will not be described in detail herein. Any known or to be known barcode scanner can be used herein without limitation. For example, a laser or optical barcode scanner is employed here.

The barcode scanner 300 is generally configured to scan a barcode affixed to the corresponding item 122 and process the scanned barcode to extract information therefrom. The barcode scanner 300 may process the barcode in a manner defined by a barcode application 352 installed on the MTS 106. Additionally, the barcode scanning application can use camera 354 to capture the barcode image for processing. The barcode application 352 can include, but is not limited to, a COTS application. The barcode scanner 300 provides the extracted information to the controller 308. As such, the barcode scanner 300 is coupled to the controller 308 via an electrical connection 360. The controller 308 uses the extracted information in accordance with the function(s) of the MTS 106. For example, the extracted information can be used by MTS 106 to enable tag deactivation functionalities thereof.

The MTS 106 also comprises a tag deactivator 310. The tag deactivator 310 comprises coils 206, an energy storage component 314 (e.g., a storage capacitor connected in series or parallel with the deactivation coils), a power source 316, a processor 318, a tag detector 320, and a memory 322. The coils 206 are provided to facilitate tag detection and tag deactivation. For tag deactivation, the coils 206 are energized to generate a magnetic field of sufficient magnitude to render the EAS security tag 120 inactive. The deactivated EAS security tag 120 no longer responds to the incident energy of the EAS system 100 so that an alarm is not triggered when the item 120 leaves the retail store.

The power source 316 is configured to charge the energy storage component 314. Current is supplied from the energy storage component 314 to the coils 206. At this time, a deactivation field is generated by the coils. The strength of the deactivation field is controlled or adjusted by the transformer 108 located in line with the coils 206.

During a purchase transaction, information acquired by the barcode scanner 300 is forwarded to the POS terminal 102 via the controller 308. Controller 308 is communicatively coupled to the POS terminal 102 through an interface 330. Operations of the tag deactivator 310 are controlled by the POS terminal 102 via the controller 308. For example, the POS terminal 102 can cause an initiation of barcode scanning operations, an initiation of tag detection operations by tag detector 320, and/or an initiation of tag deactivation operations by tag deactivator 310 when certain criteria is met. Tag detectors are well known in the art, and therefore will not be described in detail herein. Any known or to be known tag detector can be used herein without limitation.

As shown in FIG. 3, one or more sets of instructions 350 are stored in memory 332 and/or memory 324. The instructions may include customizable instructions and non-customizable instructions. The instructions 350 can also reside, completely or at least partially, within the controller 308 and/or processor 318 during execution thereof by MTS 106. In this regard, the memory 332, 324, the controller 308, and/or the processor 318 can constitute machine-readable media. The term "machine-readable media", as used herein, refers to a single medium or multiple media that stores one or more sets of instructions 350. The term "machine-readable media", as used here, also refers to any medium that is capable of storing, encoding or carrying the set of instructions 350 for execution by the MTS 106 and that causes the MTS 106 to perform one or more of the methodologies of the present disclosure.

Figure 4:
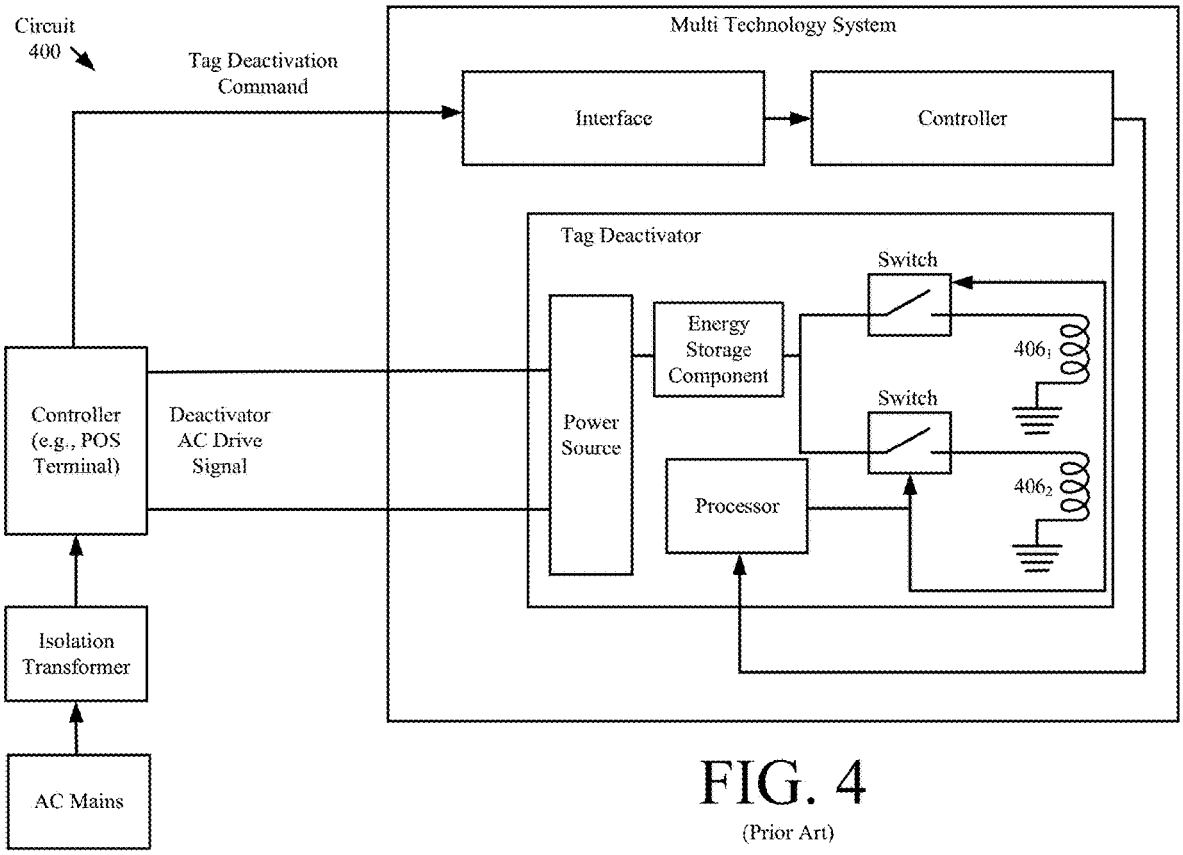
FIG. 4 (Prior Art)
FIG. 4 is a circuit diagram for a conventional circuit configured to deactivate an EAS security tag.

Referring now to FIG. 4, there is provided an illustration of a conventional circuit 400 configured to deactivate an EAS security tag. A graph 500 showing a decaying coil current waveform 502 for the conventional circuit 400 is provided in FIG. 5. The decaying coil current waveform 502 represents the current flowing through the deactivation coils $\mathbf{406}_1$, $\mathbf{406}_2$. The decaying coil current waveform 502 is sufficient to produce a magnetic field to deactivate the EAS security tag 120 when brought in proximity to the coils $\mathbf{406}_1$, $\mathbf{406}_2$. As noted above, the strength of this magnetic field is undesirable in some scenarios.

Figure 6:
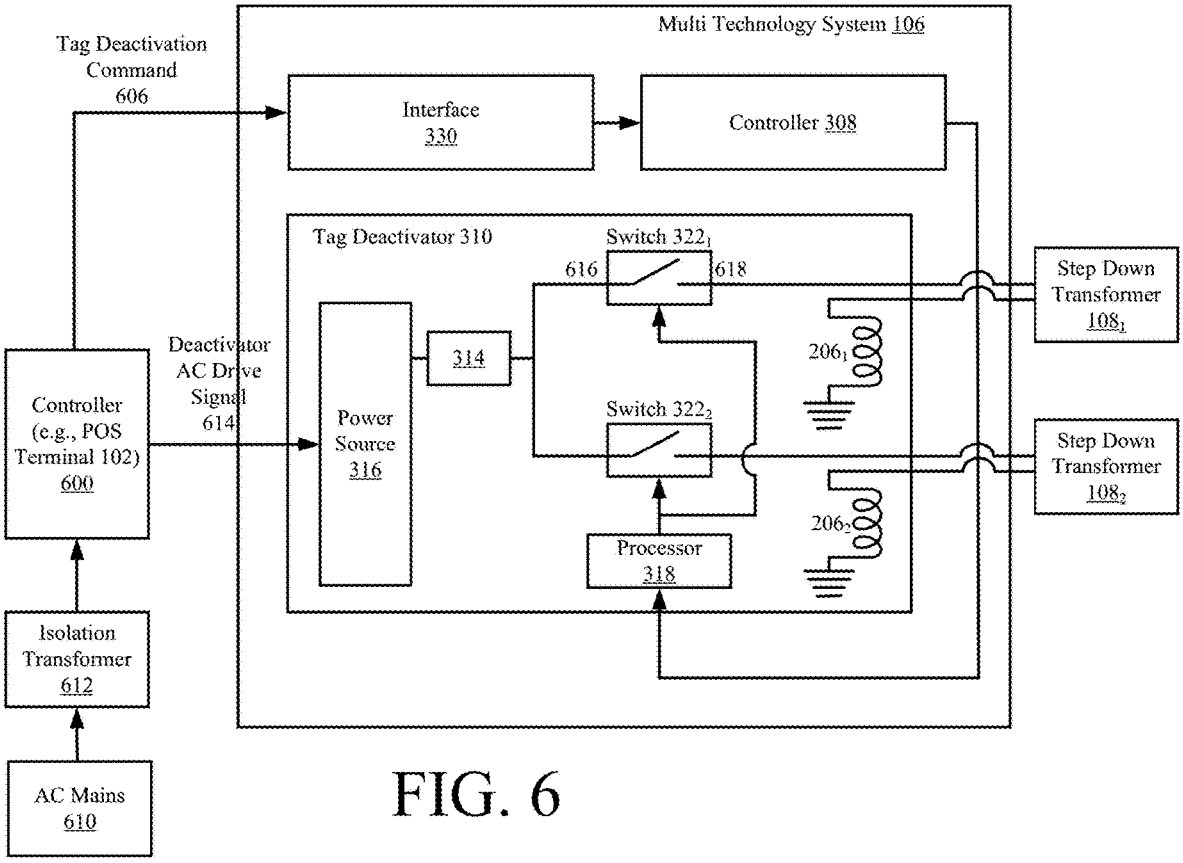
FIG. 6 is a circuit diagram for a circuit configured to deactivate an EAS security tag in accordance with the present solution.

Referring now to FIG. 6, there is provided an illustration of a circuit configured to deactivate an EAS security tag in accordance with the present solution. The circuit is similar to that shown in FIG. 4 with the addition of a transformer 108 in line with each deactivation coil of the tag deactivator.

As shown in FIG. 6, the circuit comprises a controller 600 connected to an AC mains 610 via an isolation transformer 612. The isolation transformer 612 has a primary winding with the same number of turns as the secondary winding. The controller 600 can include, but is not limited to, the POS terminal 102 of FIG. 1. The controller 600 is electronically connected to the interface 330 of the MTS 106. In this regard, the controller 600 provides a tag deactivation command 606 to the MTS 106 when certain criteria is met (e.g., when an article has been successfully purchased).

In response to the tag deactivation command 606, a switch $\mathbf{322}_1$, $\mathbf{322}_2$ is closed so as to electrically connect a deactivation coil $\mathbf{206}_1$, $\mathbf{206}_2$ to the energy storage component 314. Notably, the switches are closed in an alternating manner. In this regard, it should be understood that the switch $\mathbf{322}_1$, $\mathbf{322}_2$ has an input terminal 616 connected to the energy storage component 314 and an output terminal 618 connected to the deactivation coil $\mathbf{206}_1$, $\mathbf{206}_2$. The energy storage component 314 is charged by the power source 316 using a deactivator AC drive signal 614 provided by the controller 600. Current is supplied from the charged energy storage component 314 to the deactivation coil $\mathbf{206}_1$, $\mathbf{206}_2$ via the transformer $\mathbf{108}_1$, $\mathbf{108}_2$. At this time, the deactivation coil $\mathbf{206}_1$, $\mathbf{206}_2$ is energized and a deactivation field is generated.

The transformer $\mathbf{108}_1$, $\mathbf{108}_2$ comprises a primary winding (not shown) and a secondary winding (not shown). The primary winding is coupled to the switch's output terminal 618, and the secondary winding is coupled to the deactivation coil $\mathbf{206}_1$. In some scenarios, the turn ratio of the step down transformer $\mathbf{108}_1$, $\mathbf{108}_2$ is between 3 and 4.

Figure 5:
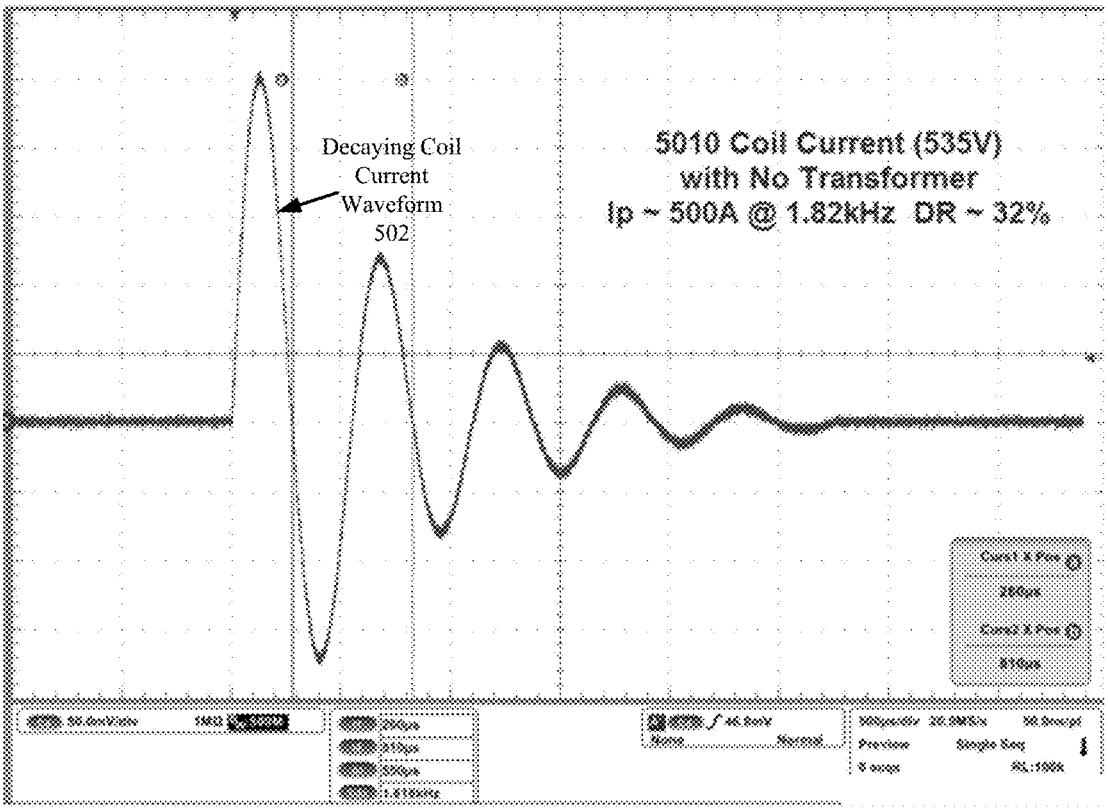
FIG. 5 is a graph illustrating a detailed amplitude profile for a coil current when a transformer is not provided in line with tag deactivation coils.
Figure 7:
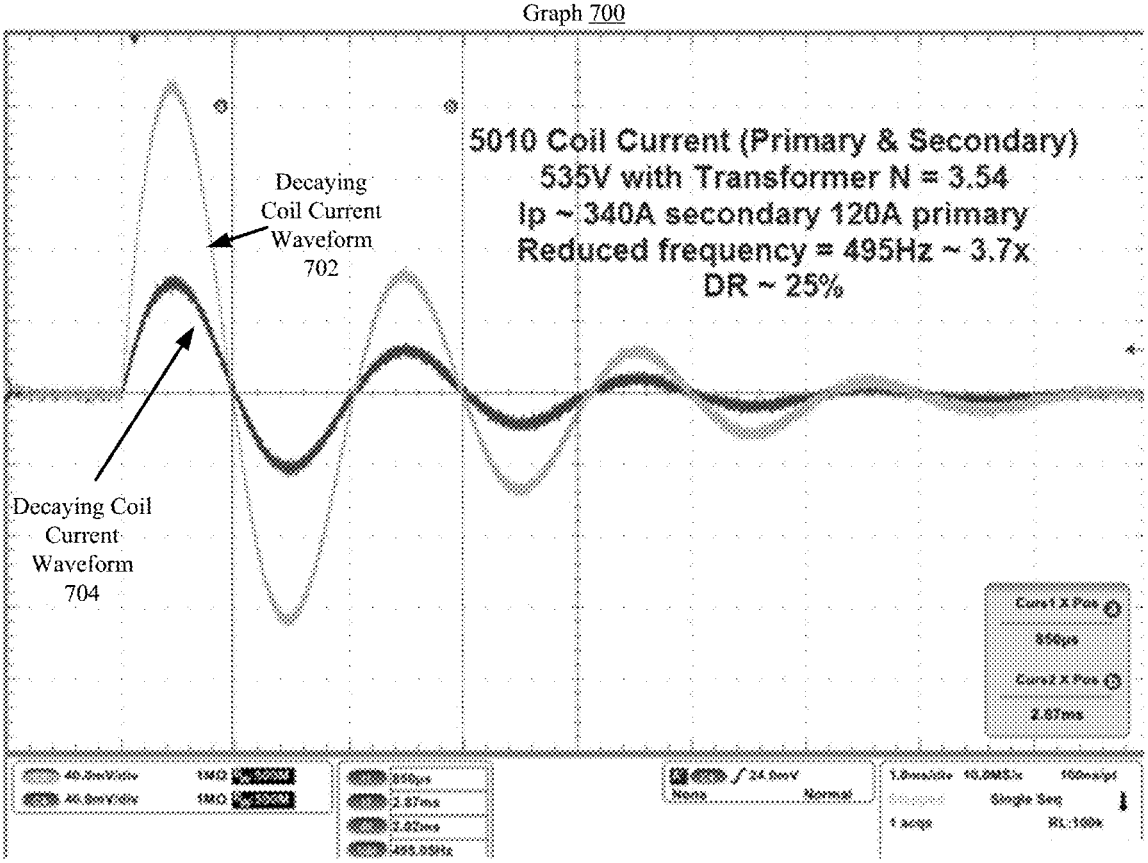
FIG. 7 is a graph illustrating a detailed amplitude profile for coil currents when a transformer is provided in line with tag deactivation coils.

A graph 700 showing the decaying coil current waveforms 702, 704 for the circuit of FIG. 6 is provided in FIG. 7. The decaying coil current waveform 702 represents the current flowing through the deactivation coil $\mathbf{206}_1$, while the decaying coil current waveform 704 represents the current flowing through the deactivation coil $\mathbf{206}_2$. As shown by FIGS. 5 and 7, the decaying coil current waveforms 702, 704 have a lower frequency than the decaying coil current waveform 502. The decaying coil current waveforms 702, 704 are sufficient to produce a magnetic field to deactivate the EAS security tag 120 when brought in proximity to the coils $\mathbf{206}_1$, $\mathbf{206}_2$.

Illustrative Method for Deactivating an EAS Security Tag

Figure 8:
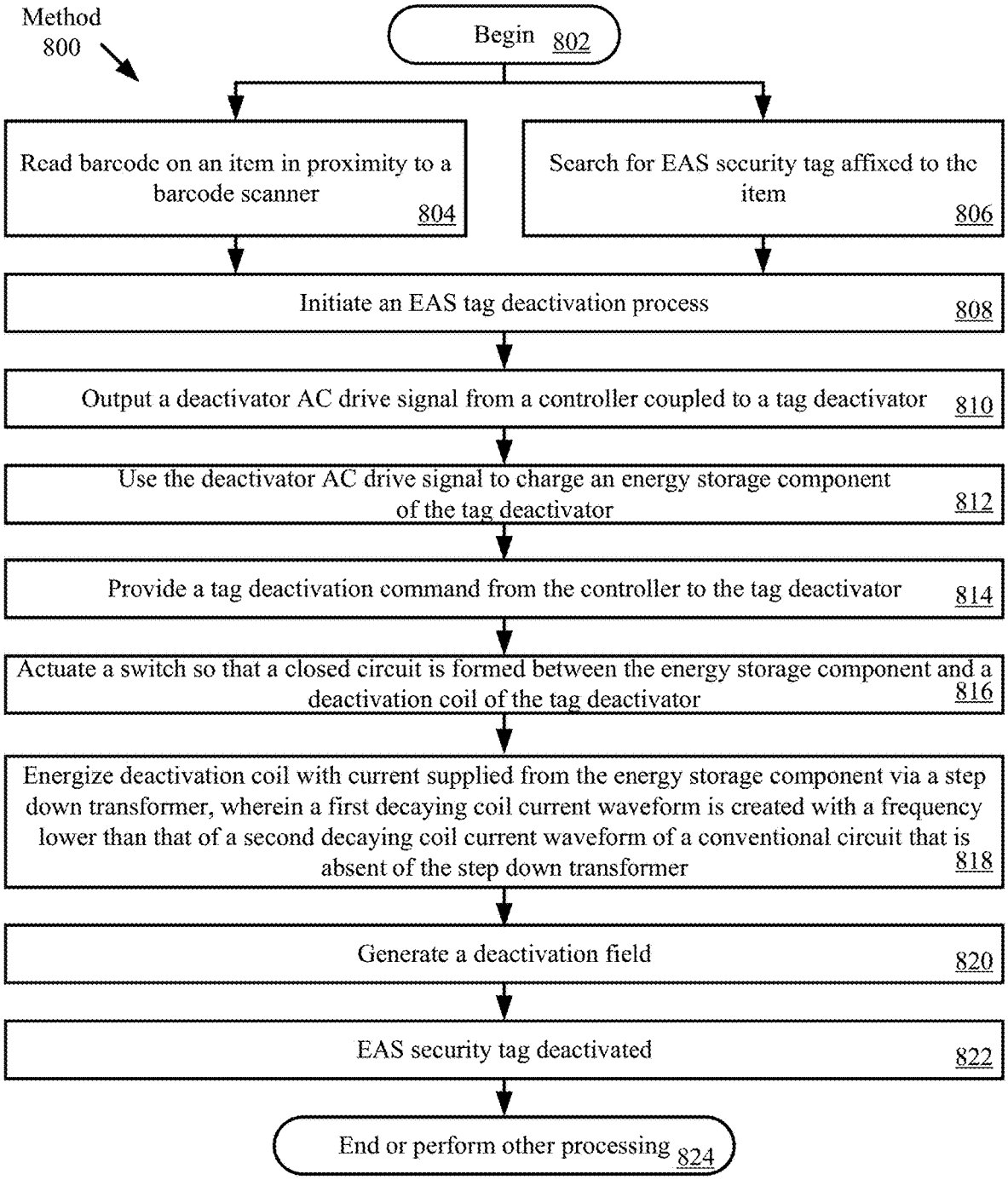
FIG. 8 is a flow diagram of an illustrative method for deactivating an EAS security tag.

Referring now to FIG. 8, there is provided a flow diagram of an illustrative method 800 for deactivating an EAS security tag (e.g., EAS security tag 120 of FIG. 1). Method 800 begins with 802 and continues with 804-806. 804-806 involve: reading a barcode (e.g., barcode 124 of FIG. 1) on an item that is in proximity to a barcode scanner (e.g., barcode scanner 300 of FIG. 3); and searching for the EAS security tag coupled or affixed to the item.

When the EAS security tag is detected and/or other criteria are met (e.g., a successful purchase of the item), an EAS tag deactivation process is initiated in 808. The tag deactivation process involves the following operations of 810-820: outputting a deactivator AC drive signal (e.g., signal 614 of FIG. 6) from a controller (e.g., POS terminal 102 of FIG. 1 or controller 600 of FIG. 6) coupled to a tag deactivator (e.g., tag deactivator 310 of FIGS. 3 and 6); using the deactivator AC drive signal to charge an energy storage component (e.g., energy storage component 314 of FIGS. 3 and 6) of the tag deactivator; providing a tag deactivation command (e.g., tag deactivation command 606 of FIG. 6) from the controller to the tag deactivator; actuating a switch (e.g., switch $\mathbf{322}_1$, $\mathbf{322}_2$ of FIGS. 3 and 6) so that a closed circuit is formed between the energy storage component and the deactivation coils (e.g., coil $\mathbf{206}_1$, $\mathbf{206}_2$ (collectively referred to as 206) of FIGS. 3 and 6) of the tag deactivator; and energizing the deactivation coil with current supplied from the energy storage component via a step down transformer (e.g., step down transformer $\mathbf{108}_1$, $\mathbf{108}_2$ of FIGS. 1 and 6).

The inclusion of the step down transformer causes a first decaying coil current waveform (e.g., waveform 702 and/or 704 of FIG. 7) to be created with a frequency lower than that of a second decaying coil current waveform (e.g., waveform 502 of FIG. 5) of a conventional circuit (e.g., circuit 400 of FIG. 4) that is absent of the step down transformer. Stated differently, the step down transformer causes a frequency of a decaying coil current waveform to be decreased. In some scenarios, the frequency is decreased by approximately the turns ratio of the transformer (e.g., to a value less than 1.8 kHz, and/or by at least half (as shown by FIGS. 5 and 7)). The present solution is not limited in this regard. The frequency can be decreased by any amount in accordance with a particular solution.

A deactivation field is generated in 820 as a result of the coil energization. In 822, the deactivation field is used to deactivate the EAS security tag. Subsequently, 824 is performed where method 800 ends or other processing is performed (e.g., place another EAS security tag in proximity to the deactivation coil(s) or return to 802 so that another iteration of the process is performed).

Although the present solution has been illustrated and described with respect to one or more implementations, equivalent alterations and modifications will occur to others skilled in the art upon the reading and understanding of this specification and the annexed drawings. In addition, while a particular feature of the present solution may have been disclosed with respect to only one of several implementations, such feature may be combined with one or more other features of the other implementations as may be desired and advantageous for any given or particular application. Thus, the breadth and scope of the present solution should not be limited by any of the above described embodiments. Rather, the scope of the present solution should be defined in accordance with the following claims and their equivalents.

What is claimed is:

1. A method for deactivating an Electronic Article Surveillance ("EAS") tag, comprising;

using an alternating current (AC) drive signal to charge an energy storage component of a tag deactivator;

selectively actuating a switch so that a closed circuit is formed between the energy storage component and at least one deactivation coil of the tag deactivator;

generating a tag deactivation field to deactivate the EAS tag by energizing the at least one deactivation coil with current supplied from the energy storage component; and decreasing, via a transformer, a frequency of a decaying coil current waveform representing a current flowing through the at least one deactivation coil.

2. The method according to claim 1, wherein the AC drive signal is provided by a controller external to the tag deactivator.

3. The method according to claim 2, wherein the switch is selectively actuated in response to a tag deactivation command based on a criteria being met.

4. The method according to claim 2, wherein the switch is selectively actuated in response to a tag deactivation command based on detection of the EAS tag.

5. The method according to claim 2, wherein the controller comprises a Point Of Sale ("POS") terminal.

6. The method according to claim 5, wherein the switch is selectively actuated in response to a tag deactivation command provided by the POS terminal when an item to which the EAS tag is coupled has been successfully purchased.

7. The method according to claim 1, wherein the transformer is a step down transformer having a turn ratio between 3 and 4.

8. The method according to claim 1, wherein the frequency is decreased to a value less than 1.8 kHz.

9. The method according to claim 1, wherein the frequency is decreased by at least half.

10. The method according to claim 1, wherein the at least one deactivation coil comprises a first coil located in a first plane that is horizontal to ground and a second coil located in a second plane that is vertical to ground.

11. A system, comprising:

a switch having an input terminal and an output terminal;

an energy storage component coupled to the input terminal;

a transformer coupled to the output terminal;

at least one deactivation coil coupled to the transformer; and a processor programmed to selectively actuate the switch so that an electrical connection is formed between the energy storage component and the at least one deactivation coil, wherein a tag deactivation field is generated for deactivating a security tag when the switch is actuated by energizing the at least one deactivation coil with current supplied from the energy storage component, and wherein the transformer causes a decrease in a frequency of a decaying coil current waveform representing a current flowing through the at least one deactivation coil.

12. The system according to claim 11, wherein the energy storage component is chargeable by an alternating current (AC) drive signal provided by a controller external to the system.

13. The system according to claim 12, wherein the switch is selectively actuated in response to a tag deactivation command based on a criteria being met.

14. The system according to claim 12, wherein the switch is selectively actuated in response to a tag deactivation command based on detection of an Electronic Article Surveillance ("EAS") tag.

15. The system according to claim 12, wherein the controller comprises a Point Of Sale ("POS") terminal.

16. The system according to claim 15, wherein the switch is selectively actuated in response to a tag deactivation command provided by the POS terminal when an item to which an Electronic Article Surveillance ("EAS") tag is coupled has been successfully purchased.

17. The system according to claim 11, wherein the transformer is a step down having a turn ratio between 3 and 4.

18. The system according to claim 11, wherein the frequency is decreased to a value less than 1.8 kHz.

19. The system according to claim 11, wherein the frequency is decreased by at least half.

20. The system according to claim 11, wherein the at least one deactivation coil comprises a first coil located in a first plane that is horizontal to ground and a second coil located in a second plane that is vertical to ground.

* * * * *